US006542139B1

(12) United States Patent
Kanno

(10) Patent No.: US 6,542,139 B1
(45) Date of Patent: Apr. 1, 2003

(54) MATRIX TYPE DISPLAY APPARATUS

(75) Inventor: Hiromasa Kanno, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/544,465

(22) Filed: Apr. 7, 2000

(30) Foreign Application Priority Data

Oct. 8, 1999 (JP) ..... 11-288237

(51) Int. Cl.[7] ..... G09G 3/36

(52) U.S. Cl. ..... 345/87; 345/90; 345/92; 345/98; 345/132

(58) Field of Search ..... 345/87, 90, 92, 345/93, 96, 127, 132, 136, 138, 698

(56) References Cited

U.S. PATENT DOCUMENTS 5,917,466 A * 6/1999 Soda et al. ..... 345/100
6,127,995 A * 10/2000 Furuhashi et al.
6,268,841 B1 * 7/2001 Cairns et al. ..... 345/98
6,310,602 B1 * 10/2001 Kasai et al. ..... 345/132
6,326,981 B1 * 12/2001 Mori et al.

* cited by examiner

*Primary Examiner*—Vijay Shankar
*Assistant Examiner*—Prabodh Dharia
(74) *Attorney, Agent, or Firm*—Rabin & Berdo, P.C.

(57) ABSTRACT

A matrix type display apparatus such as a liquid crystal display is provided which has a simple circuit structure and is capable of enlarging the display of a screen. A shift section is provided with 1024 FF (flip-flop) circuits. When enlarged display mode is designated by a mode signal MOD, one FF circuit is connected in parallel to two FF circuits via a switch SW (an analog switch). Accordingly, R, G, B data for 640 pixels is increased to 960 display voltages and fed to the Y electrodes of a liquid crystal panel. A shift section is provided with 768 FF (flip-flop) circuits. When enlarged display mode is designated, one FF circuit is connected in parallel to two FF circuits via a switch SW. Accordingly, scan voltages for 720 lines are generated from the scan signals of 480 lines and fed to the X electrodes of a liquid crystal panel. Accordingly, a screen display is enlarged vertically and horizontally by a factor of 1.5.

13 Claims, 9 Drawing Sheets

MATRIX TYPE DISPLAY APPARATUS

BACKGROUND OF THE INVENTION

1. Field of the Invention

The present invention relates to a matrix type display apparatus such as a liquid crystal display (hereinafter referred to as an LCD), and particularly to a technique for the enlarged display of a screen.

2. Description of the Related Art

FIG. 2 is a structural diagram of a conventional LCD.

This LCD displays image signals supplied from a personal computer or the like (referred to below as a PC) on a color screen having a size of 1024 pixels horizontally by 768 pixels vertically. This LCD comprises a control circuit 10, a display signal circuit 20, a scan signal circuit 30, and a liquid crystal panel 40.

Red, green, and blue color image signals formed from R, G, and B signals, clock signals CLK showing timings of a sampling of these R, G, and B signals, horizontal synchronizing signals HSYN, and vertical synchronizing signals VSYN are fed to the input side of the control circuit 10 from an unillustrated PC. On the basis of these signals, the control circuit 10 then generates start signals EI, clock signals CK, R, G, B data, and strobe signals STB and outputs these to the display signal circuit 20. The control circuit 10 also has the function of generating start signals ST and clock signals CP and outputting these to the scan signal circuit 30.

The display signal circuit 20 is provided with a 1024 stage shift register 21 which corresponds to the 1024 pixels in the horizontal direction, data latches 22 and 23, and a display drive section 24. The shift register 21 sequentially shifts and holds the start signals EI based on the clock signals CK and the held contents of each stage are fed to each stage of the data latch 22 as latch signals L1, L2, etc up to L1024. The data latch 22 holds the R, G, B data fed from the control circuit 10 based on the latch signals L1 to L1024.

The data latch 23 stores the R, G, B data of the 1024 horizontal pixels held by the data latch 22 at the strobe signal STB timing. The display drive section 24 generates display voltages S1, S2 etc up to S3072 which correspond to R, G, B data of the 1024 pixels stored in the data latch 23 and outputs these display voltages.

The scan signal circuit 30 is provided with a 768 stage shift register 31 and scan drive section 32 for sequentially scanning and displaying the 768 pixels in the vertical direction in horizontal line units. The shift register 31 holds the start signals ST in the initial stage register as scan signals and then sequentially shifts these scan signals in accordance with the timing of the clock signals CP. The contents at each stage of the shift register 31 are fed to the scan drive section 32 and are output as scan voltages G1, G2, etc up to G768.

The liquid crystal panel 40 is provided with 768 X electrodes X1, X2, etc up to X768 arranged at equal spacing in a line direction, and 1024 groups (note that each group is made up of 3 electrodes corresponding to R, G, and B) of Y electrodes Y1, Y2, etc up to Y3072 arranged at equal spacing in a column direction. Color pixel display is performed in line units in accordance with display voltages S1 to S3072 applied respectively to the Y electrodes Y1 to Y3072 at locations where an X electrode Xj to which a scan voltage Gj (wherein j is a number from 1 to 768) is applied intersects with a Y electrode Y1 to Y3072.

In this type of LCD, when R, G, B signals, clock signals CLK, horizontal synchronizing signals HSYN, and vertical synchronizing signals VSYN are supplied from a PC, horizontal cycle start signals EI and, thereafter, in synchronization with the clock signals CLK, R, G, B data is sequentially transmitted in single pixel units from the control circuit 10 to the display signal circuit 20. In the shift register 21, latch signals L1 to L1024 are generated in accordance with the clock signals CK. R, G, B data is further sequentially held in the data latch 22 in synchronization with the latch signals L1 to L1024.

When the R, G, B data of the 1024 pixels of a single line is held in the data latch 22, a strobe signal STB is output from the control circuit 10. Accordingly, the R, G, B data of the single line in the data latch 22 is also stored in the data latch 23. In the display drive section 24, display voltages S1 to S3072 are generated based on the R, G, B data of the 1024 pixels stored in the data latch 23 and are output.

Moreover, start signals ST for each vertical cycle and clock signals CP for shifting the start signals ST and generating scan signals are output from the control circuit 10 to the scan signal circuit 30. When the start signals ST are supplied, the output signal of the initial stage of the shift register 31 of the scan signal circuit 30 is set to a level "H" for designating display and output signals of subsequent stages are set to a level "L" for designating non-display. Output signals of each stage of the shift register 31 are then sequentially shifted one stage at a time towards the rear in synchronization with the clock signals CP which correspond to the horizontal cycle. The output signals of each stage of the shift register 31 are fed to the scan drive section 32 and scan voltages G1 to G768 are generated for each line in accordance with the display/non-display and output.

The display voltages S1 to S3072 which correspond to the R, G, B data of a single line output from the display drive section 24 are fed to the Y electrodes Y1 to Y3072 of the liquid crystal panel 40. Moreover, the scan voltages G1 to G768 output from the scan drive section 32 are fed to the X electrodes X1 to X768 of the liquid crystal panel 40. The timing of the strobe signals STB fed from the control circuit 10 to the display signal circuit 20 is substantially identical to the timing of the clock signals CP fed to the scan signal circuit 30. Therefore, a single line which corresponds to the X electrode Xj driven by the scan voltage Gj output from the scan drive section 32 is displayed through the display voltages S1 to S3072 based on the R, G, B data for the single line stored in the data latch 23. In addition, all other X electrodes other than the X electrode Xj are placed in a non-display state.

A screen is displayed by the X electrodes X1 to X768 being sequentially driven from top to bottom by the scan voltages G1 to G768 sequentially output from the scan drive section 32.

However, this type of conventional LCD has the following problems.

For example, when an image signal supplied from a PC is for displaying on a 640 horizontal pixel by 480 vertical pixel screen, no pixel data exists for displaying at the right hand side and bottom of a liquid crystal panel 40 having 1024 horizontal pixels by 768 vertical pixels. Therefore, the problem has existed that the displayed screen is small and the display position is offset to the top left.

In order to solve this problem, attempts have been made to provide a processing device and frame memory corresponding to the resolution of the liquid crystal panel 40 in the LCD. Image signals fed from the PC are interpolated by this processing device and converted into image data for a 1024 horizontal pixel by 768 vertical pixel screen and displayed.

However, in this type of method, because a large amount of frame memory and a high speed processing device are necessary, the problem arises that costs are increased and the amount of power needed to run the processing device at high speed also increases.

SUMMARY OF THE INVENTION

The present invention solves the above problems in the conventional technology and provides a matrix type display apparatus such as an LCD which has a simple circuit structure and which is capable of enlarging the display of a screen.

In order to solve the above problems, the first aspect of the present invention is a matrix type display apparatus comprising: display means having M number of X electrodes (wherein M is a number greater than one) arranged in parallel, N number of Y electrodes (wherein N is a number greater than one) arranged so as to intersect the X electrodes, and display elements provided at each point of intersection of the X electrodes and Y electrodes, the display means performing a matrix type display at the points of intersection of the N number of Y electrodes and the X electrodes which are driven by scan voltage in accordance with a display voltage applied to each Y electrode; scan drive means for generating the scan voltage in order to sequentially drive the X electrodes; and display drive means for holding image data which corresponds to the X electrodes driven by the scan drive means, and for generating the display voltage based on the held image data and driving each of the Y electrodes, wherein the scan drive means and the display drive means have the following structure.

Namely, the scan drive means is provided with M number of flip-flop circuits (referred to below as "FF circuits") and switches for altering the connections of the M number of FF circuits and, in normal display mode, the scan drive means forms shift registers having M number of stages by connecting the M number of FF circuits in series and also generates the scan voltages based on each output signal of the M number of FF circuits and, in enlarged display mode, the scan drive means forms shift registers having m number of stages (wherein m is a number less than M) by connecting a portion of the M number of FF circuits in parallel at a constant ratio and also generates the scan voltages based on each output signal of the M number of FF circuits.

Moreover, the display drive means is provided with N number of FF circuits and switches for altering the connections of the N number of FF circuits and, in the normal display mode, the display drive means forms shift registers having N number of stages by connecting the N number of FF circuits in series and also holds the image data based on each output signal of the N number of FF circuits and generates the display voltages in accordance with the image data and, in the enlarged display mode, the display drive means forms shift registers having n number of stages (wherein n is a number less than N) by connecting a portion of the N number of FF circuits in parallel at the constant ratio and also holds the image data based on each output signal of the N number of FF circuits and generates the display voltages in accordance with the image data.

The second aspect of the present invention is the matrix type display apparatus according to the first aspect, wherein switches in the scan drive means and the display drive means are formed from analog switches (referred to below as "SW") controlled by mode signals which designate the normal display mode or the enlarged display mode.

According to the first and second aspects of the present invention, because the above described structure is employed, the following operation can be performed.

In normal display mode, the M number of FF circuits in the scan drive means are connected in series by switches such as SW or the like. Scan voltages are sequentially generated from each FF circuits and fed to the X electrodes of the display means. The N number of FF circuits in the display drive means are also connected in series by switches. Image data based on output signals sequentially output from each FF circuit is held, and display voltages are generated in accordance with the image data and fed to the Y electrodes of the display means.

In contrast, in enlarged display mode, the M number of FF circuits in the scan drive means are connected in parallel and in series at a constant ratio by switches. Scan voltages are generated based on output signals from each FF circuit and fed to the X electrodes of the display means. The N number of FF circuits in the display drive means are also connected in parallel and in series at a constant ratio by switches. Image data based on output signals from each FF circuit is held, and display voltages are generated in accordance with the image data and fed to the Y electrodes of the display means.

The third aspect of the present invention is the matrix type display apparatus according to the first and second aspects, wherein the scan drive means is provided with a plurality of integrated circuits used for shifting which are connected in a cascade connection and, in the enlarged display mode, the scan drive means simultaneously drives outputs of scan voltages for front or rear non-display regions based on selection signals which correspond to the integrated circuit connection position.

The fourth aspect of the present invention is the matrix type display apparatus according to the third aspect, wherein selection signals for a plurality of integrated circuits in the scan drive means are directly fed from ground voltage or power supply voltage supplying the integrated circuits.

According to the third and fourth aspects of the present invention, the following operation is performed in the scan drive means in the matrix type display apparatus according to the first and second aspects of the present invention.

Selection signals corresponding to the connection positions at which a plurality of integrated circuits used for shifting are connected in a cascade connection in the scan drive means are directly fed, for example, from a power supply and ground voltage identical to the integrated circuits. In enlarged display mode, the output of scan voltages for front and rear non-display regions is stopped based on the selection signals.

DESCRIPTION OF THE PREFERRED EMBODIMENTS

First Embodiment

Figure 1:
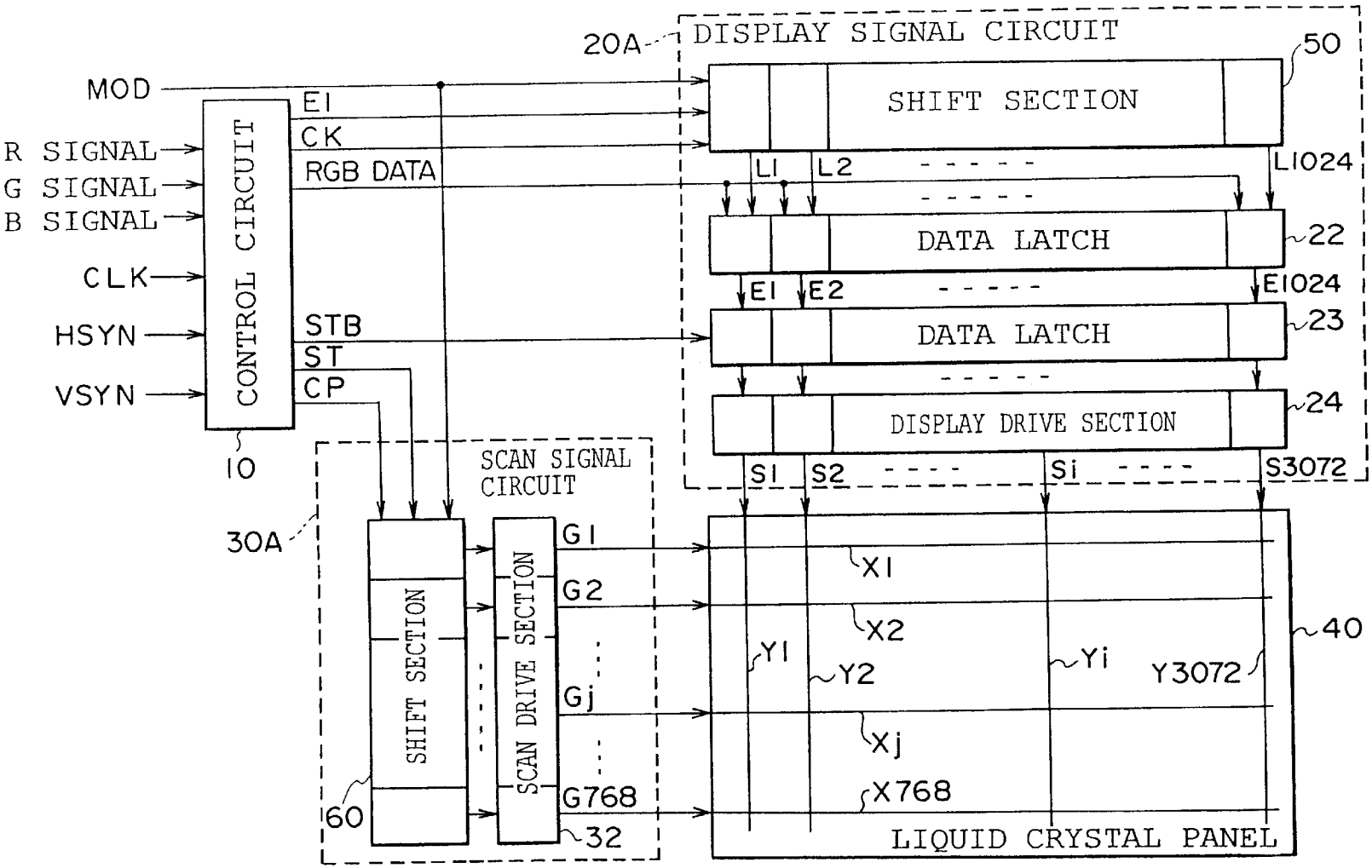
FIG. 1 is a structural diagram of an LCD showing the first embodiment of the present invention.

FIG. 1 is a structural diagram of an LCD showing the first embodiment of the present invention. Elements in FIG. 1 which are common to the conventional LCD shown in FIG. 2 are given the same symbols.

Figure 2:
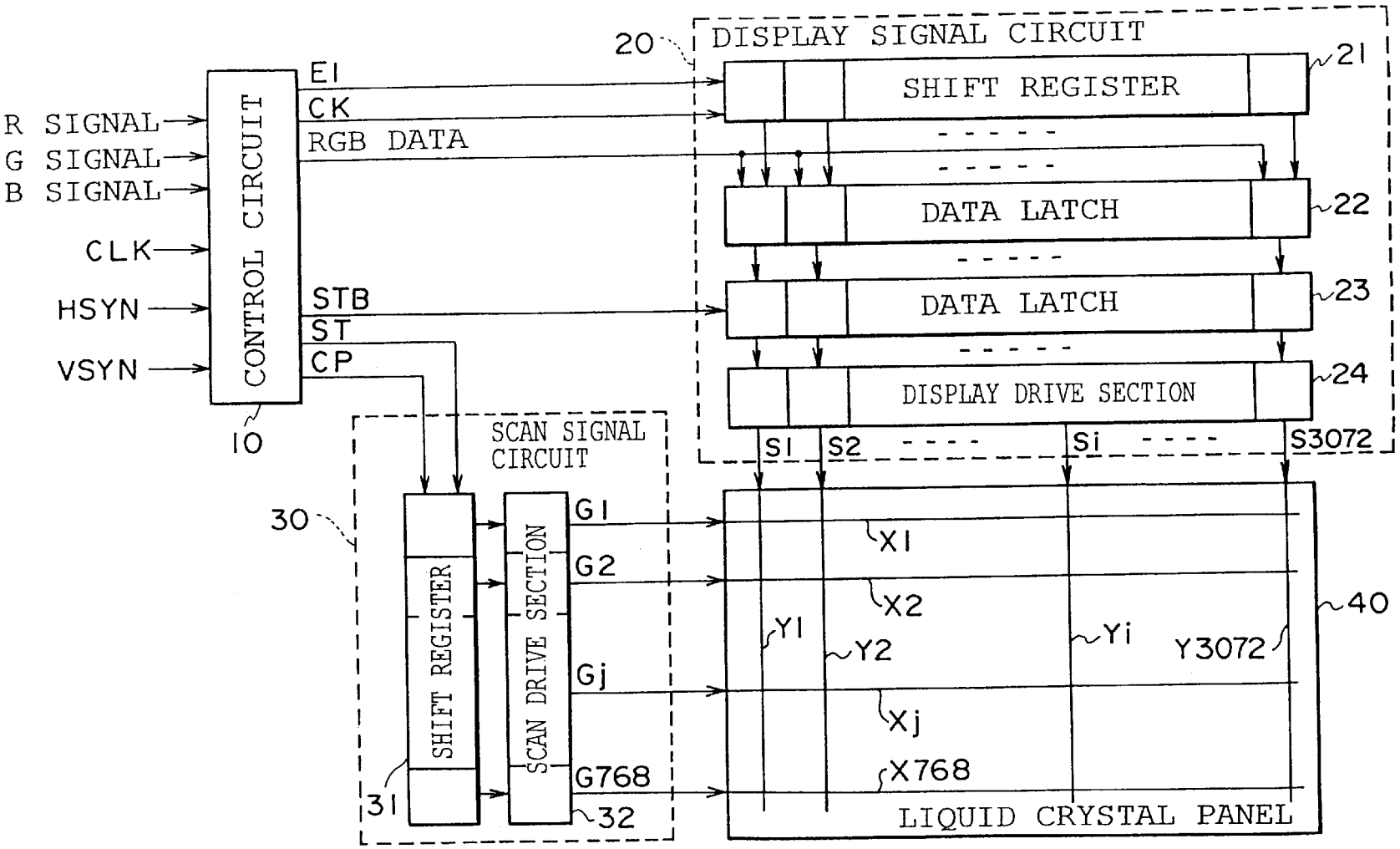
FIG. 2 is a structural diagram of a conventional LCD

In the same manner as in the conventional LCD shown in FIG. 2, the LCD shown in FIG. 1 displays image signals fed from a PC on a color screen having 1024 horizontal pixels by 768 vertical pixels. However, in addition to the conventional normal display mode, the LCD of FIG. 1 is provided with an enlarged display mode for enlarging both the horizontal and vertical directions by a factor of 1.5 of an image signal of, for example, 640 pixels horizontally by 480 pixels vertically in order for the image signal to be displayed on a screen of 960pixels in a horizontal direction by 720 pixels in a vertical direction.

This LCD comprises a control circuit 10, display drive means 20A (for example, a display signal circuit), scan drive means 30A (for example, a scan signal circuit), and display means 40 (for example, a liquid crystal panel).

An unillustrated PC is connected to the input side of the control circuit 10. Red, green, and blue color image signals formed from R, G, and B signals, clock signals CLK showing timings of a sampling of these R, G, and B signals, horizontal synchronizing signals HSYN, and vertical synchronizing signals VSYN are fed to the input side of the control circuit 10 from the PC.

On the basis of the clock signals CLK, the horizontal synchronizing signals HSYN, and the R, G, and B signals, the control circuit 10 generates start signals EI, clock signals CK, R, G, B data, and strobe signals STB and outputs these to the display signal circuit 20A. The control circuit 10 also has the function of generating start signals ST and clock signals CP based on the horizontal and vertical synchronizing signals HSYN and VSYN and outputting these to the scan signal circuit 30A.

The display signal circuit 20A comprises a shift section 50 which is provided with 1024 FF circuits corresponding to the 1024 horizontal pixels, data latches 22 and 23, and a display drive section 24.

In addition to the start signals EI and the clock signals CK fed from the control circuit 10, mode signals MOD for designating either normal display mode or enlarged display mode are also fed into the shift section 50. When normal display mode is designated, the shift section 50 forms a 1024 stage shift register by connecting 1024 FF circuits in series. When enlarged display mode is designated, the shift section 50 forms a 683 stage shift register by connecting one FF circuit in parallel to two FF circuits.

The shift section 50 sequentially shifts and holds the start signals EI using the shift register formed as described above in accordance with the clock signals CK and outputs the output signals of each FF circuit as latch signals L1, L2, etc up to L1024. The output side of the shift section 50 is connected to latch terminals at each stage of the data latch 22. The data latch 22 sequentially holds the R, G, B data fed from the control circuit 10 to the data input side of the data latch 22 based on the latch signals L1 to L1024.

The data latch 23 stores the R, G, B data of the 1024 pixels of a single line held by the data latch 22 at the timing of the strobe signals STB. The display drive section 24 generates display voltages S1, S2 etc up to S3072 which correspond to the R, G, B data for the 1024 pixels stored in the data latch 23 and outputs these display voltages.

The scan signal circuit 30A comprises a shift section 60 provided with 768 FF circuits which correspond to the 768 lines stacked vertically and a scan drive section 32.

In addition to the start signals ST and the clock signals CP fed from the control circuit 10, mode signals MOD are also fed to the shift section 60. When normal display mode is designated, the shift section 60 forms a 768 stage shift register by connecting 768 FF circuits in series. When enlarged display mode is designated, the shift section 60 forms a 512 stage shift register by connecting one FF circuit in parallel to two FF circuits.

The shift section 60 holds each start signal ST in the initial stage FF circuit as a scan signal using the shift register formed as described above, and then shifts these scan signals in sequence from top to bottom in accordance with the timing of the clock signal CP. The FF circuit output signals of each stage are fed to the scan drive section 32 and from there scan voltages G1, G2, etc up to G768 are output.

The liquid crystal panel 40 is the same as that used in the conventional apparatus shown in FIG. 2 and is provided with 768 X electrodes X1, X2, etc up to X768 arranged at equal spacing in a line direction, and 1024 groups of Y electrodes Y1, Y2, etc up to Y3072 arranged at equal spacing in a column direction. An unillustrated liquid crystal display element and an active element such as a thin film transistor are formed at the locations of each three-dimensional intersection of a Y electrode Yi (wherein i is a number from 1 to 3072) and an X electrode Xj (wherein j is a number from 1 to 768). The gate and source of the thin film transistor are connected respectively to the X electrode Xj and the Y electrode Yi. A drain is connected to an unillustrated common electrode via a liquid crystal display element.

Scan voltages G1 to G768 are applied respectively from the scan drive section 32 to the X electrodes X1 to X768 of the liquid crystal panel 40. Display voltages S1 to S3072 are applied respectively from the display drive section 24 to the Y electrodes Y1 to Y3072. Color pixels are displayed in line units in accordance with the display voltages S1 to S3072 applied to the Y electrodes Y1 to Y3072 at each of the locations where an X electrode Xj to which a scan voltage Gj is applied intersects with a Y electrode Y1 to Y3072.

Figure 3:
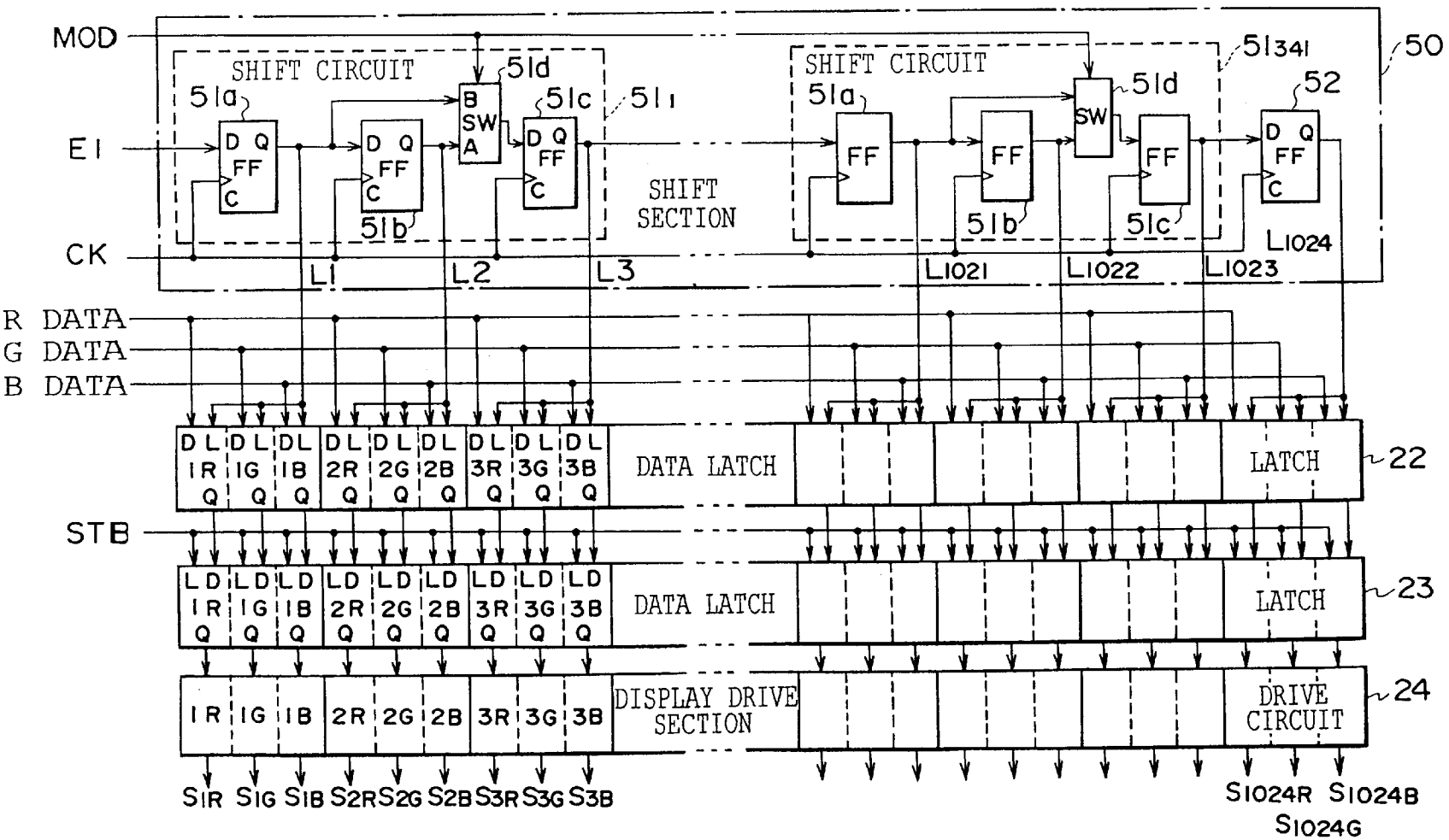
FIG. 3 is a structural diagram of the display signal circuit 20A shown in FIG. 1.

FIG. 3 is a structural diagram of the display signal circuit 20A shown in FIG. 1.

The shift section 50 of this display signal circuit 20A comprises 341 shift circuits $\mathbf{51}_1$ to $\mathbf{51}_{341}$ connected in a cascade connection and a delay type FF circuit 52 connected to the final stage of the shift circuit $\mathbf{51}_{341}$. Each of the shift circuits $\mathbf{51}_1$ to $\mathbf{51}_{341}$ is structured in the same way. For example, shift circuit $\mathbf{51}_1$ comprises delay type FF circuits 51*a*, 51*b*, 51*c*, and a switch SW 51*d*.

Start signals EI are fed to the input side of the initial shift circuit $\mathbf{51}_1$, namely to the input terminal D of the FF circuit 51*a*. FF circuits 51*a* and 51*b* are connected in a cascade connection and the output terminal Q and input terminal D of the FF circuit 51*b* are connected respectively to the input terminals A and B of the SW 51*d*.

Mode signals MOD are fed to the selection terminal of the SW 51*d*. When the mode signal MOD is set to a level "L", indicating normal display mode, the input terminal A is connected to the output side. When the mode signal MOD is set to a level "H", indicating enlarged display mode, the input terminal B is connected to the output side. The output side of the SW 51*d* is connected to the input terminal D of the FF circuit 51*c*. The output terminal Q of the FF circuit 51*c* is connected to the input side of the next shift circuit $\mathbf{51}_2$. The output terminal Q of the FF circuit 51*c* of the final shift circuit $\mathbf{51}_{341}$ is connected to the input terminal D of the FF circuit 52. Clock signals CK are fed in common to the clock terminals C of the FF circuits 51*a* to 51*c* of each shift circuit $\mathbf{51}_1$ to $\mathbf{51}_{341}$ and to the FF circuit 52.

The FF circuits 51*a* to 51*c* of each shift circuit $\mathbf{51}_1$ to $\mathbf{51}_{341}$ and the FF circuit 52 output latch signals L1, L2, etc up to L1024 to the data latch 22 based on the clock signals CK. The output terminals Q of the FF circuits 51*a* to 51*c* of each shift circuit $\mathbf{51}_1$ to $\mathbf{51}_{341}$ and the FF circuit 52 are connected to the corresponding latch terminals L of latches $\mathbf{22}_{iR}$, $\mathbf{22}_{iG}$, and $\mathbf{22}_{iB}$ (wherein i is a number from 1 to 1024) which form the data latch 22.

Namely, the output terminal Q of the FF circuit 51*a* of the initial shift circuit $\mathbf{51}_1$ is connected in common to the latch terminals L of the latches $\mathbf{22}_{1R}$, $\mathbf{22}_{1G}$, and $\mathbf{22}_{1B}$. The output terminal Q of the FF circuit 51*b* of the initial shift circuit $\mathbf{51}_1$ is connected in common to the latch terminals L of the latches $\mathbf{22}_{2R}$, $\mathbf{22}_{2G}$, and $\mathbf{22}_{2B}$. The output terminal Q of the FF circuit 51*c* of the initial shift circuit $\mathbf{51}_1$ is connected in common to the latch terminals L of the latches $\mathbf{22}_{3R}$, $\mathbf{22}_{3G}$, and $\mathbf{22}_{3B}$. Thereafter, all the shift circuits in sequence up to the final shift circuit $\mathbf{51}_{341}$ are connected in the same way. The output terminal Q of the FF circuit 51*a* of the final shift circuit $\mathbf{51}_{341}$ is connected in common to the latch terminals L of the latches $\mathbf{22}_{1021R}$, $\mathbf{22}_{1021G}$, and $\mathbf{22}_{1021B}$. The output terminal Q of the FF circuit 51*b* of the final shift circuit $\mathbf{51}_{341}$ is connected in common to the latch terminals L of the latches $\mathbf{22}_{1022R}$, $\mathbf{22}_{1022G}$, and $\mathbf{22}_{1022B}$. The output terminal Q of the FF circuit 51*c* of the final shift circuit $\mathbf{51}_{341}$ is connected in common to the latch terminals L of the latches $\mathbf{22}_{1023R}$, $\mathbf{22}_{1023G}$, and $\mathbf{22}_{1023B}$. Moreover, the output terminal Q of the final FF circuit 52 is connected in common to the latch terminals L of the latches $\mathbf{22}_{1024R}$, $\mathbf{22}_{1024G}$, and $\mathbf{22}_{1024B}$.

Each latch $\mathbf{22}_{iR}$ holds R data in synchronization with the latch signals Li and R data is fed in common from the control circuit 10 to the data terminals D of each latch $\mathbf{22}_{iR}$. Furthermore, Each latch $\mathbf{22}_{iG}$ and $\mathbf{22}_{iB}$ respectively holds G and B data in synchronization with the latch signals Li and G and B data is fed in common from the control circuit 10 respectively to the data terminals D of each latch $\mathbf{22}_{iG}$ and $\mathbf{22}_{iB}$.

The output terminals Q of each data latch $\mathbf{22}_{iR}$, $\mathbf{22}_{iG}$, and $\mathbf{22}_{iB}$ of the data latch 22 are connected respectively to the input terminals D of the data latches $\mathbf{23}_{iR}$, $\mathbf{23}_{iG}$, and $\mathbf{23}_{iB}$ which form the data latch 23. Strobe signals STB from the control circuit 10 are fed in common to the latch terminals L of each data latch $\mathbf{23}_{iR}$, $\mathbf{23}_{iG}$, and $\mathbf{23}_{iB}$ of the data latch 23.

Furthermore, the output terminals Q of each data latch $\mathbf{23}_{iR}$, $\mathbf{23}_{iG}$, and $\mathbf{23}_{iB}$ of the data latch 23 are connected respectively to the input side of the drive circuits $\mathbf{24}_{iR}$, $\mathbf{24}_{iG}$, and $\mathbf{24}_{iB}$ of the display drive section 24. Display voltages $S_{iR}$, $S_{iG}$, and $S_{iB}$ which correspond respectively to red, green, and blue are output from the output side of the drive circuits $\mathbf{24}_{iR}$, $\mathbf{24}_{iG}$, and $\mathbf{24}_{iB}$.

Figure 4:
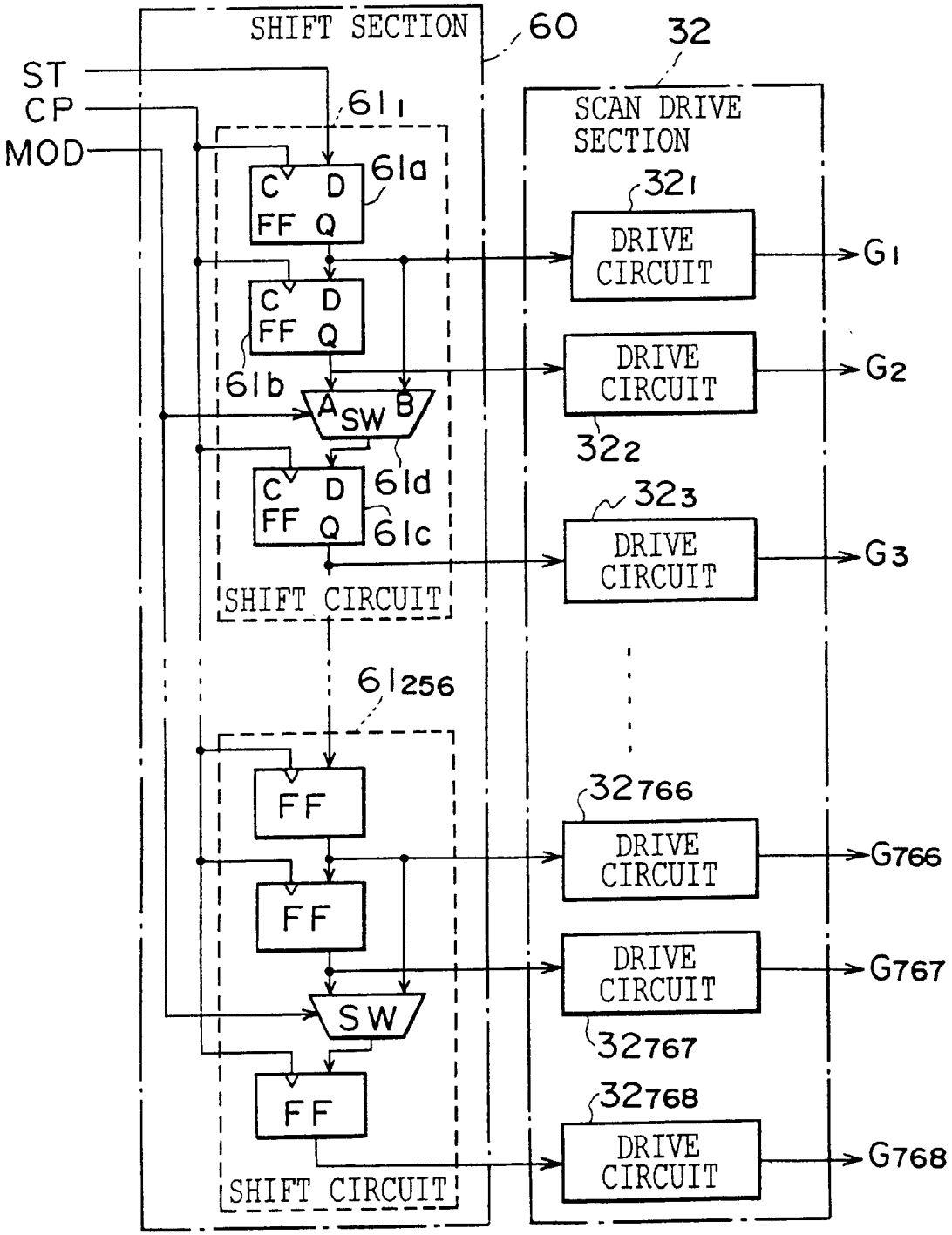
FIG. 4 is a structural diagram of the scan signal circuit 30A shown in FIG. 1.

FIG. 4 is a structural diagram of the scan signal circuit 30A shown in FIG. 1.

The shift section 60 of this scan signal circuit 30A comprises 256 shift circuits $\mathbf{61}_1$ to $\mathbf{61}_{256}$ connected in a cascade connection. Each shift circuit $\mathbf{61}_1$ to $\mathbf{61}_{256}$ has the same structure. For example, shift circuit $\mathbf{61}_1$ comprises a switch SW 61*d* and delay type FF circuits 61*a*, 61*b*, 61*c* connected in a cascade connection. Start signals ST are fed to the input side of the initial shift circuit $\mathbf{61}_1$, namely to the input terminal D of the FF circuit 61*a*. FF circuits 61*a* and 61*b* are connected in a cascade connection and the output terminal Q and input terminal D of the FF circuit 61*b* are connected respectively to the input terminals A and B of the SW 61*d*. A mode signal MOD is fed to the selection terminal of the SW 61*d*. When this mode signal MOD is set to a level "L", the input terminal A is connected to the output side. When the mode signal MOD is set to a level "H", the input terminal B is connected to the output side. The output side of the SW 61*d* is connected to the input terminal D of the FF circuit 61*c*. The output terminal Q of the FF circuit 61*c* is connected to the input side of the next shift circuit $\mathbf{61}_2$. Clock signals CP are fed in common to the clock terminals C of the FF circuits 61*a* to 61*c* of each shift circuit $\mathbf{61}_1$ to $\mathbf{61}_{256}$.

The FF circuits 61*a* to 61*c* of each shift circuit $\mathbf{61}_1$ to $\mathbf{61}_{256}$ output scan signals in sequence based on the clock signals CP. The output terminals Q of the FF circuits 61*a* to 61*c* of each shift circuit $\mathbf{61}_1$ to $\mathbf{61}_{256}$ are connected to the input side of the corresponding drive circuit 32*j* (wherein j is a number from 1 to 768) of the scan drive section 32.

Namely, the output terminal Q of the FF circuit 61*a* of the initial shift circuit $\mathbf{61}_1$ is connected to the input side of the drive circuit $\mathbf{32}_1$. The output terminals Q of the FF circuits 61*a* and 61*b* of the initial shift circuit $\mathbf{61}_1$ are connected respectively to the input sides of the drive circuits $\mathbf{32}_2$ and $\mathbf{32}_3$. Thereafter, the output terminals Q of the FF circuits 61*a* to 61*c* of all the shift circuits in succession up to the final shift circuit $\mathbf{61}_{256}$ are connected in the same way. The output terminals Q of the FF circuits 61*a* to 61*c* of the final shift circuit $\mathbf{61}_{256}$ are connected respectively to the input sides of the drive circuits $\mathbf{32}_{766}$ to $\mathbf{32}_{768}$. Scan voltages G1 to G768 are generated by the drive circuits $\mathbf{32}_1$ to $\mathbf{32}_{768}$ and are output.

Next, while referring to FIGS. 3 and 4, the operation of the embodiment shown in FIG. 1 in both normal display mode (1) and enlarged display mode (2) will be described.

(1) Normal Display Mode

In normal display mode, the mode signal MOD is set to "L" and the input terminal A is selected in the SW 51*d* in each of the shift circuits $\mathbf{51}_1$ to $\mathbf{51}_{341}$ shown in FIG. 3. Accordingly, the 1024 FF circuits 51*a* and the like in the shift section 50 are all connected in series thus forming a 1024 stage shift register. In the same way, the input terminal A is selected in the SW 61*d* in each of the shift circuits $\mathbf{61}_1$ to $\mathbf{61}_{256}$ shown in FIG. 4. Accordingly, the 768 FF circuits 61*a* and the like in the shift section 60 are all connected in series thus forming a 768 stage shift register. This type of display operation occurring in the LCD is the same as the display operation which occurs in the conventional LCD shown in FIG. 2.

Namely, when the R, G, B signals of an image signal, clock signals CLK, horizontal synchronizing signals HSYN, and vertical synchronizing signals VSYN are fed from a PC, horizontal cycle start signals EI and thereafter R, G, B data in synchronization with clock signals CK are sequentially transmitted in single pixel units from the control circuit 10 to the display signal circuit 20A. Latch signals L1 to L1024 are generated in the shift section 50 based on the clock signals CK. Moreover, the R, G, B data is held in sequence in the data latch 22 in synchronization with the latch signals L1 to L1024.

At the point when the R, G, B data of the 1024 pixels of a single line is held by the data latch 22, a strobe signal STB is output from the control circuit 10. Consequently, the R, G, B data of the single line held in the data latch 22 is stored as a single batch in the data latch 23. Based on the R, G, B data of the 1024 pixels stored in the data latch 23, display voltages S1 to S3072 are generated in the display drive section 24 and are output.

In contrast, vertical cycle start signals ST and clock signals CP for shifting the start signals ST and generating scan signals are output from the control circuit 10 to the scan signal circuit 30A. When a start signal ST is supplied, the output signal of the initial FF circuit 61*a* of the shift section 60 of the scan signal circuit 30A is set to "H", and output signals of subsequent FF circuits 61*b* and so on are set to "L". Output signals of each FF circuit 61 of the shift section 60 are then sequentially shifted one stage at a time towards the rear in synchronization with the clock signals CP which correspond to the horizontal cycle. The output signals of each stage of the shift section 60 are fed to the scan drive section 32 and scan voltages G1 to G768 are generated for each line in accordance with the display/non-display and output.

The display voltages (S1R, S1G, S1B) to (S1024R, S1024G, S1024B) which correspond to the R,G, B data of the pixels of a single line output from the display drive section 24 are fed to the Y electrodes Y1 to Y3072 of the liquid crystal panel 40. The scan voltages G1 to G768 output from the scan drive section 32 are also fed to the X electrodes X1 to X768 of the liquid crystal panel 40. The timing of the strobe signals STB fed from the control circuit 10 to the display signal circuit 20A is substantially identical to the timing of the clock signals CP fed to the scan signal circuit 30A. Therefore, a single line which corresponds to the X electrode Xj driven by the scan voltage Gj output from the scan drive section 32 is displayed through the display voltages S1 to S3072 based on the R, G, B data for the single line stored in the data latch 23. In addition, all other X electrodes other than the X electrode Xj are placed in a non-display state.

A single screen is displayed by the X electrodes X1 to X768 being sequentially driven from top to bottom by the scan voltages G1 to G768 sequentially output from the scan drive section 32.

(2) Enlarged Display Mode

Figure 5:
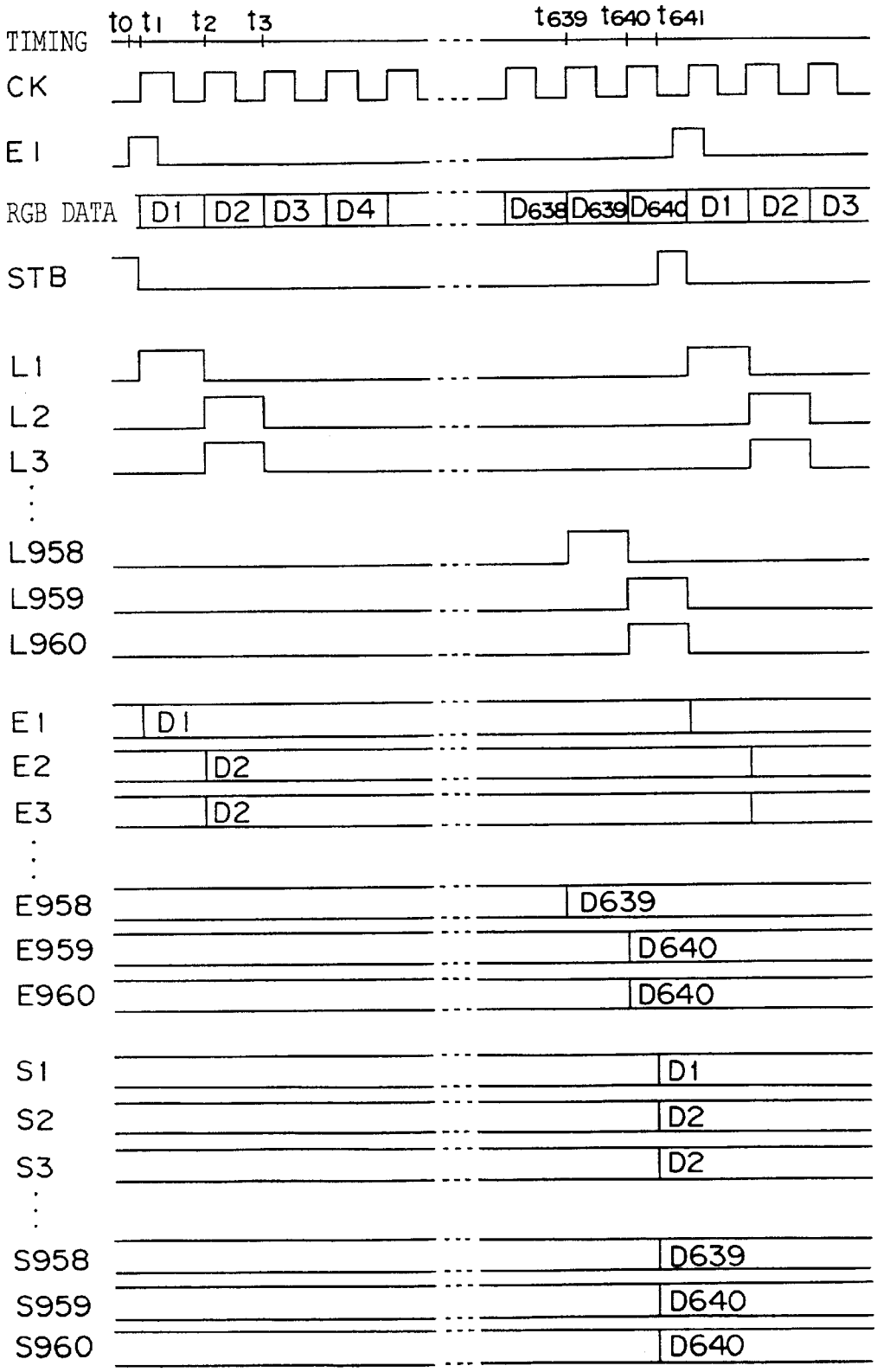
FIG. 5 is a time chart showing an operation of the display signal circuit 20A of FIG. 3 when in enlarged display mode.
Figure 6:
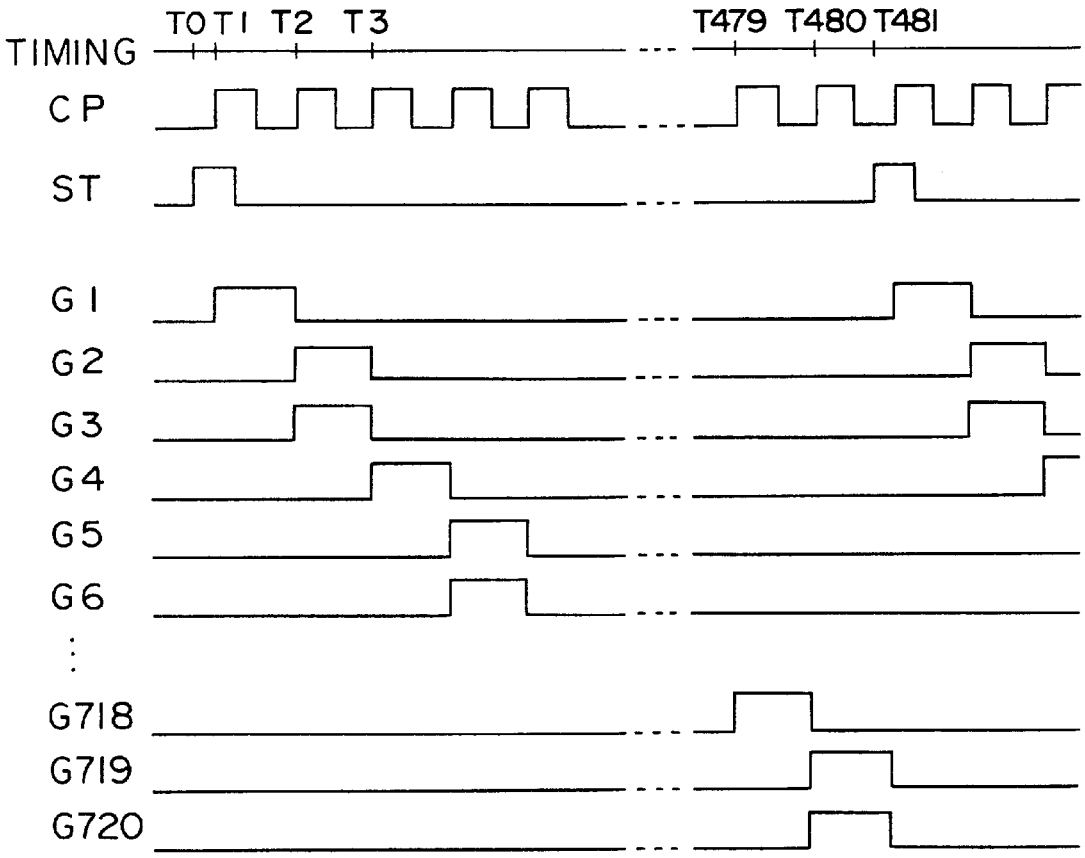
FIG. 6 is a time chart showing an operation of the scan signal circuit 30A of FIG. 4 when in enlarged display mode.

FIGS. 5 and 6 are time charts respectively showing operations of the display signal circuit 20A of FIG. 3 and the scan signal circuit 30A of FIG. 4 when in enlarged display mode.

In enlarged display mode, the mode signal MOD is set to "H". Image signals of the 640 pixels in the horizontal direction are fed in synchronization with the clock signals CLK for each horizontal synchronizing signal HSYN fed from the PC. In addition, one vertical synchronizing signal VSYN is fed for every 480 horizontal synchronizing signals HSYN.

When the mode signal is set to "H", the input terminals B are selected in each of the switches SW 51*d* in each of the shift circuits $\mathbf{51}_1$ to $\mathbf{51}_{341}$ shown in FIG. 3. Accordingly, the FF circuits 51*b* and 51*c* are connected in parallel to the output sides of the FF circuit 51*a* in each of the shift circuits $\mathbf{51}_1$ to $\mathbf{51}_{341}$. Two stage shift registers are thus formed in each of the shift circuits $\mathbf{51}_1$ to $\mathbf{51}_{341}$. Consequently, a 683 stage shift register is formed in the shift section 50.

A start signal EI is generated at the timing t0 in FIG. 5. A clock signal CK is then generated at the timing t1. A latch signal L1 output from the FF circuit 51*a* of the shift circuit $\mathbf{51}_1$ is set to "H". As a result, R, G, B data D1 is held in the latches $\mathbf{22}_{1R}$, $\mathbf{22}_{1G}$, and $\mathbf{22}_{1B}$ of the data latch 22. The output signal E1 from the latch $\mathbf{22}_1$ then becomes the R, G, B data D1.

At the generation of the clock signal CK at the timing t2, the latch signal L1 output from the FF circuit 51*a* of the shift circuit $\mathbf{51}_1$ changes to "L" and the latch signals L2 and L3 output from the FF circuits 51*b* and 51*d* simultaneously change to "H". As a result, the same R, G, B data D2 is held in the latches $\mathbf{22}_{2R}$, $\mathbf{22}_{2G}$, $\mathbf{22}_{2B}$ and $\mathbf{22}_{3R}$, $\mathbf{22}_{3G}$, $\mathbf{22}_{3B}$ of the data latch 22. The output signals E2 and E3 of the latches $\mathbf{22}_2$ and $\mathbf{22}_3$ are also changed to the same R, G, B data D2.

Because each shift circuit $\mathbf{51}_i$ forms a two stage shift register structure, of the two sets of R, G, B data $D_{2i-1}$ and $D_{2i}$, the R, G, B data $D_{2i-1}$ is held in the latch $\mathbf{22}_{3i-2}$ and the R, G, B data $D_{2i}$ is held in the two latches $\mathbf{22}_{3i-1}$ and $\mathbf{22}_{3i}$. At the generation of the clock signal CK at the timing t640, when the latch signals L959 and L960 are changed to "H", the R, G, B data 640 is held in the latches $\mathbf{22}_{959}$ and $\mathbf{22}_{960}$. The output signals E959 and E960 of the latches $\mathbf{22}_{959}$ and $\mathbf{22}_{960}$ are also changed to the R, G, B data D640.

Furthermore, when the strobe signal STB is generated at the timing t641, the R, G, B data D1 to D640 held in each latch $\mathbf{22}_1$ to $\mathbf{22}_{960}$ is stored in a bundle in the data latch 23. The R, G, B data D1 to D640 stored in the data latch 23 is fed to the display drive section 24 where display signals S1 to S2880 are generated and applied to the corresponding Y electrodes Y1 to Y2880 of the liquid crystal panel 40.

In this manner, the R, G, B data D1 to D640 of the 640 pixels in the horizontal direction is enlarged to the display signals S1 to S2880 of 960 pixels and fed to the Y voltages Y1 to Y2880 of the liquid crystal panel 40.

The operation of the enlarged display mode in the scan signal circuit 30A shown in FIG. 4 is substantially the same as that carried out in the display signal circuit 20A.

Namely, when the mode signal MOD is set to "H", the input terminals B are selected in each of the switches SW 61*d* in each of the shift circuits $\mathbf{61}_1$ to $\mathbf{61}_{256}$ shown in FIG. 4. Accordingly, the FF circuits 61*b* and 61*c* are connected in parallel to the output sides of the FF circuit 61*a* in each of the shift circuits $\mathbf{61}_1$ to $\mathbf{61}_{256}$. Two stage shift registers are thus formed in each of the shift circuits $\mathbf{61}_1$ to $\mathbf{61}_{256}$. Consequently, a 512 stage shift register is formed in the shift section 60.

A start signal ST is generated at the timing T0 in FIG. 6. A clock signal CP is then generated at the timing T1. The output signal from the FF circuit 61*a* of the shift circuit $\mathbf{61}_1$ is set to "H" and a scan signal G1 is output. At the generation of the clock signal CP at the timing T2, the output signal from the FF circuit 61*a* of the shift circuit $\mathbf{61}_1$ changes to "L" and the output signals from the FF circuits 61*b* and 61*c* simultaneously change to "H". As a result, scan signals G2 and G3 are simultaneously output.

Because each shift circuit $\mathbf{61}_j$ forms a two stage shift register structure, when two pulses of the clock signal CP are supplied, a scan voltage G3j−2 is output at the first pulse and two scan voltages G3j−1 and G3j are output at the second pulse. At the generation of the clock signal CP at the timing T480, the scan voltages G719 and G720 are output. In this manner, 720 scan voltages G1 to G720 are generated for 480 pulses of the clock signal CP and fed to the X electrodes X1 to X720 of the liquid crystal panel 40.

Furthermore, when the start signal ST is generated at the timing T481, the display of one screen is completed and the display line returns to the first line.

As a result, in the enlarged display mode, an image signal of 640 horizontal pixels by 480 vertical pixels fed from a PC is enlarged to 960 horizontal pixels by 720 vertical pixels and displayed on a liquid crystal panel 40.

In the manner described above, the LCD according to the first embodiment has shift sections 50 and 60 provided with switches SW for connecting all the FF circuits in series when in normal display mode and for connecting one FF circuit in parallel to two FF circuits when in enlarged display mode. Therefore, the present embodiment has the advantage that the supplied screen data can be enlarged by a factor of 1.5 and displayed on the liquid crystal panel 40 with practically no increase in the size of the circuit.

Second Embodiment

Figure 7:
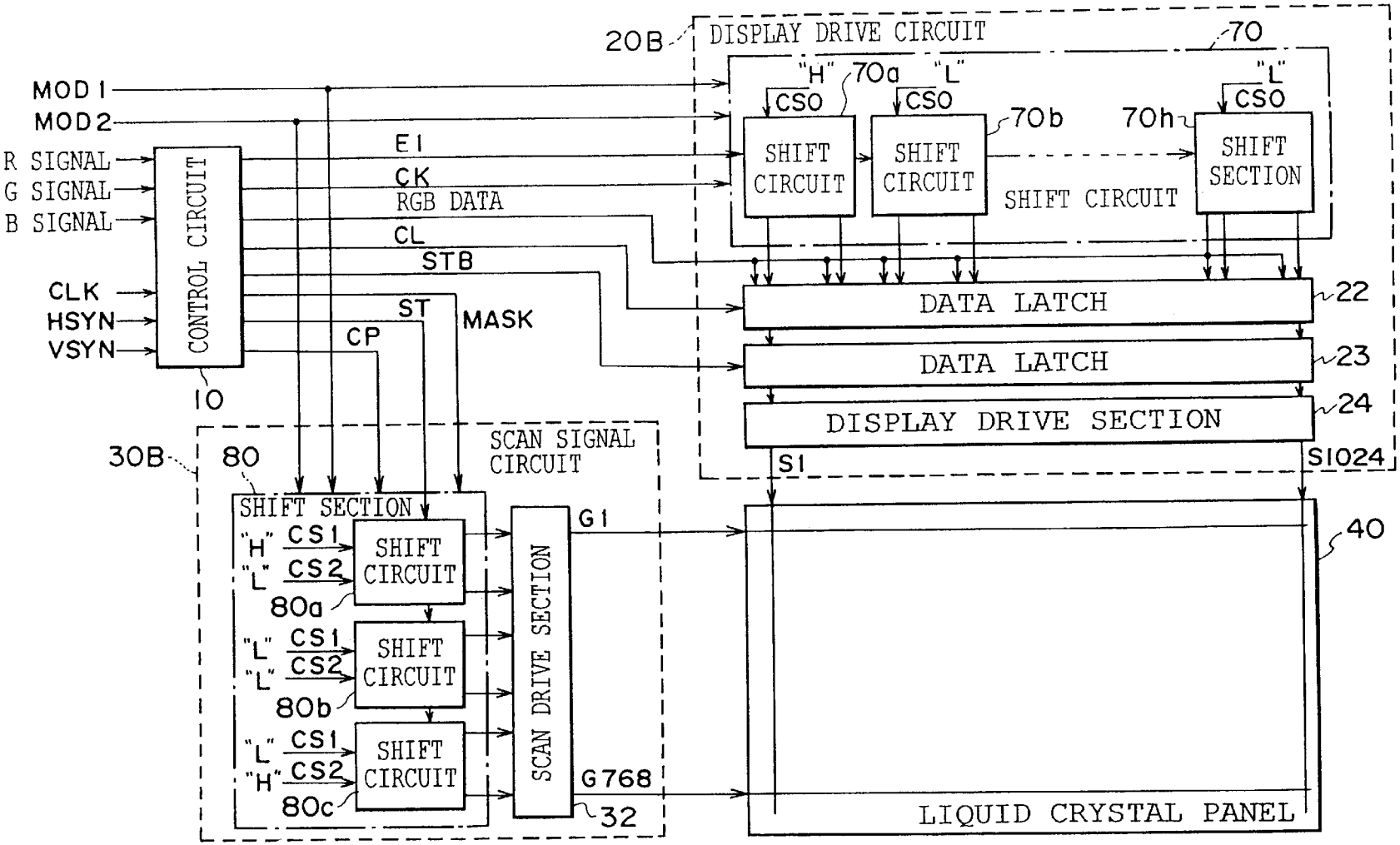
FIG. 7 is a structural diagram of an LCD showing the second embodiment of the present invention.

FIG. 7 is a structural diagram of an LCD showing the second embodiment of the present invention. The same symbols are given to the same elements found in FIG. 1.

In addition to a normal display mode for displaying without alteration an image signal fed from a PC or the like on a color screen of 1024 horizontal pixels by 768 vertical pixels, this LCD is further provided with a 1.25 magnification display mode for enlarging an image by a factor of 1.25 and displaying the image, and a 1.6 magnification display mode for enlarging an image by a factor of 1.6 and displaying the image.

The 1.25 magnification display mode enlarges an image signal of 800 horizontal pixels by 600 vertical pixels by a factor of 1.25 in both the horizontal and vertical directions to be displayed on a screen having 1000 horizontal pixels by 750 vertical pixels. In this case, the screen is displayed in the center portion of the liquid crystal panel 40 and non-display portions are disposed around the peripheral portions.

The 1.6 magnification display mode enlarges an image signal of 640 horizontal pixels by 480 vertical pixels by a factor of 1.6 in both the horizontal and vertical directions to be displayed on a screen having 1024 horizontal pixels by 768 vertical pixels.

Instead of the shift sections 50 and 60 shown in FIG. 1, this LCD is further provided with shift sections 70 and 80 both having different structures.

In the shift section 70, eight integrated circuits for shifting (e.g. shift circuits) 70*a*, 70*b*, etc to 70*h* are connected in a cascade connection. In addition to the normal display mode, mode signals MOD 1 and MOD 2 for designating the 1.25 and 1.6 magnification display modes are fed into the shift section 70. Furthermore, although each shift circuit 70*a* to 70*h* is identical, a selection signal CS0 is supplied for designating variations in operation depending on the location of the shift circuit. For example, an "H" selection signal CS0 is fed from the power supply voltage of the circuit substrate to the first shift circuit 70*a*, while an "L" selection signal CS0 is fed from the ground voltage to the shift circuits 70*b* to 70*h*.

In the shift section 80, three integrated circuits for shifting (e.g. shift circuits) 80*a*, 80*b*, and 80*c* are connected in a cascade connection. Mode signals MOD 1 and MOD 2 are fed to the shift section 80 in the same manner as for the shift section 70. Furthermore, although each shift circuit 80*a* to 80*c* is identical, selection signals CS1 and CS2 are supplied for designating variations in operation depending on the location of the shift circuit. "H" and "L" are fed from the power supply voltage and ground voltage of the circuit substrate to the first shift circuit 80a as selection signals CS1 and CS2. "L" is fed from the ground voltage to the intermediate shift circuit 80*b* as selection signals CS1 and CS2. Moreover, "L" and "H" respectively are fed from the ground voltage and power supply voltage to the last shift circuit 80*c* as selection signals CS1 and CS2. The rest of the structure is the same as that shown in FIG. 1.

Figure 8:
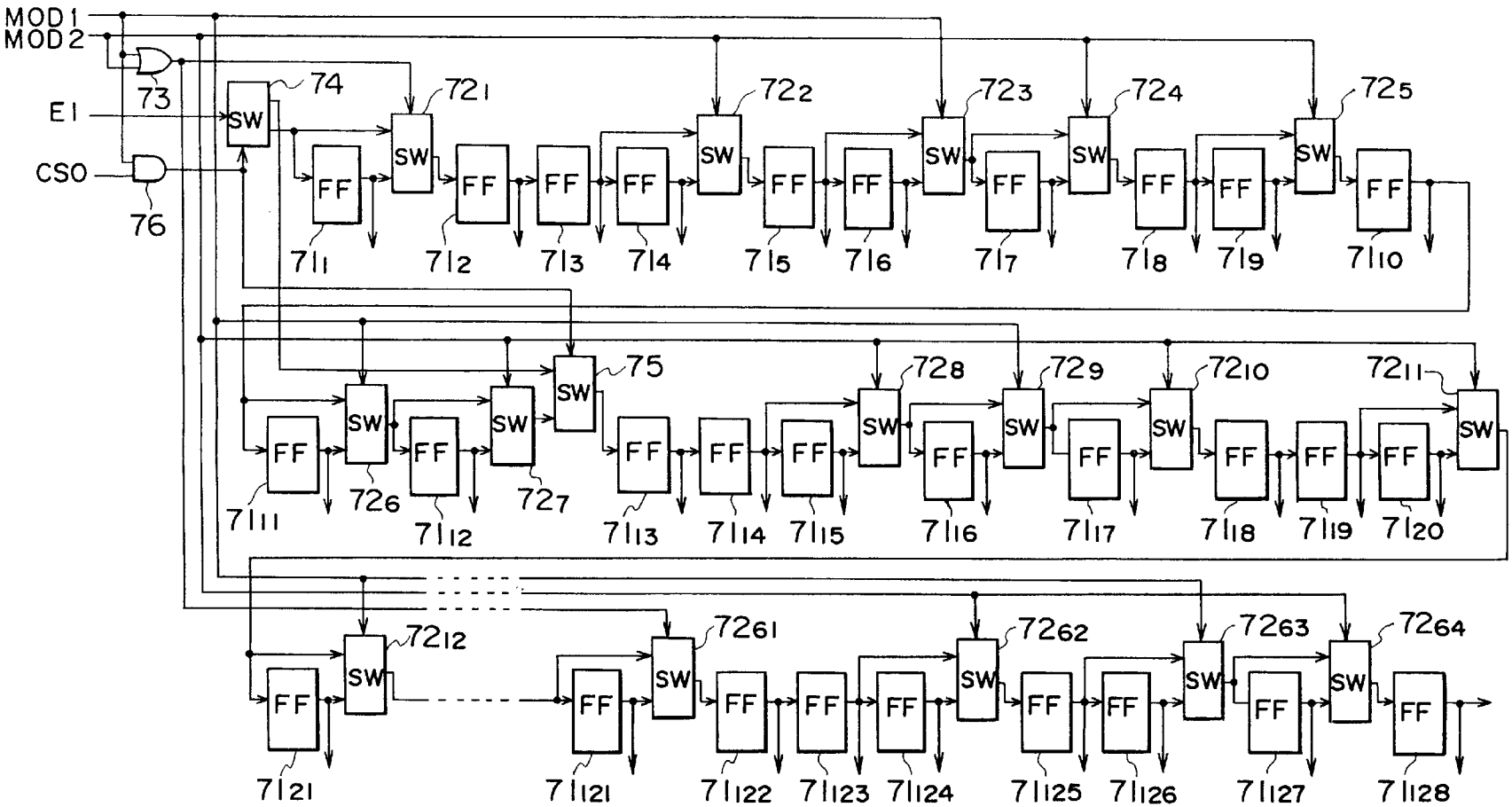
FIG. 8 is a structural diagram of the shift circuit 70*a* in FIG. 7.

FIG. 8 is a structural diagram of the shift circuit 70*a* shown in FIG. 7.

The basic structure of the shift circuit 70*a* is substantially the same as that of the shift circuit $\mathbf{51}_1$ shown in FIG. 3. Namely, the shift circuit 70*a* is provided with 128 FF circuits $\mathbf{71}_1$, $\mathbf{71}_2$, etc up to $\mathbf{71}_{128}$ for sequentially shifting start signals EI towards the rear in synchronization with clock signals CK and switches $\mathrm{SW}\mathbf{72}_1$, $\mathbf{72}_2$, $\mathbf{72}_3$, etc up to $\mathbf{72}_{64}$ for connecting a portion of the FF circuits (for example, FF $\mathbf{71}_1$, $\mathbf{71}_4$, etc) in parallel. Note that, although omitted from FIG. 8, clock signals CK are applied in common to the clock terminals of each FF circuit $\mathbf{71}_1$ to $\mathbf{71}_{128}$.

When "L" is fed to the control terminals of the switches $\mathrm{SW}\mathbf{72}_1$ to $\mathrm{SW}\mathbf{72}_{64}$, the output side of the FF circuit 71 immediately before the SW is connected to the input side of the FF circuit 71 immediately after the SW. When "H" is fed to the control terminals of the switches $\mathrm{SW}\mathbf{72}_1$ to $\mathrm{SW}\mathbf{72}_{64}$, the input side of the FF circuit 71 immediately before the SW is connected to the input side of the FF circuit 71 immediately after the SW.

For example, an OR of mode signals MOD1 and MOD2 is fed to the control terminal of $\mathrm{SW}\mathbf{72}_1$ via a two input OR gate 73. Mode signals MOD2 and MOD 1 are also fed respectively to the control terminals of $\mathrm{SW}\mathbf{72}_2$ and $\mathrm{SW}\mathbf{72}_3$.

In 1.25 magnification mode, by setting the mode signal MOD1 to "H" , one FF circuit 71 is connected in parallel to four FF circuits 71 connected in series by the switches $\mathrm{SW}\mathbf{72}_1$ to $\mathbf{72}_{64}$. Five latch signals (for example L1 to L5) are output from five FF circuits 71 for four clock signal CK pulses. In 1.6 magnification mode, by setting the mode signal MOD2 to "H", three FF circuits 71 are connected in parallel to five FF circuits 71 connected in series. Eight latch signals (for example L1 to L8) are then output from eight FF circuits 71 for five clock signal CK pulses.

The shift circuit 70*a* is further provided with switches SW74 and 75 for switching the connection with the start signal EI between the FF circuit $\mathbf{71}_1$ and the FF circuit $\mathbf{71}_{13}$. A start signal EI is fed to the input side of the switch SW74 and the first output side of this switch SW74 is connected to the input side of the FF circuit $\mathbf{71}_1$. The second output side of the SW74 is connected to the second input side of the switch SW75, while the output side of the switch $\mathrm{SW}\mathbf{72}_7$ is connected to the first input side of the SW75. In addition, the output side of the switch SW75 is connected to the input side of the FF circuit $\mathbf{71}_{13}$.

An AND of mode signal MOD1 and selection signal CS0 is fed to the control terminals of switches SW74 and 75 via a two input AND gate 76. Consequently, only when both the mode signal MOD1 and the selection signal CS0 are "H" does the start signal EI not pass through the FF circuits $\mathbf{71}_1$ to $\mathbf{71}_{12}$ but is input directly to the FF circuit $\mathbf{71}_{13}$.

Figure 9:
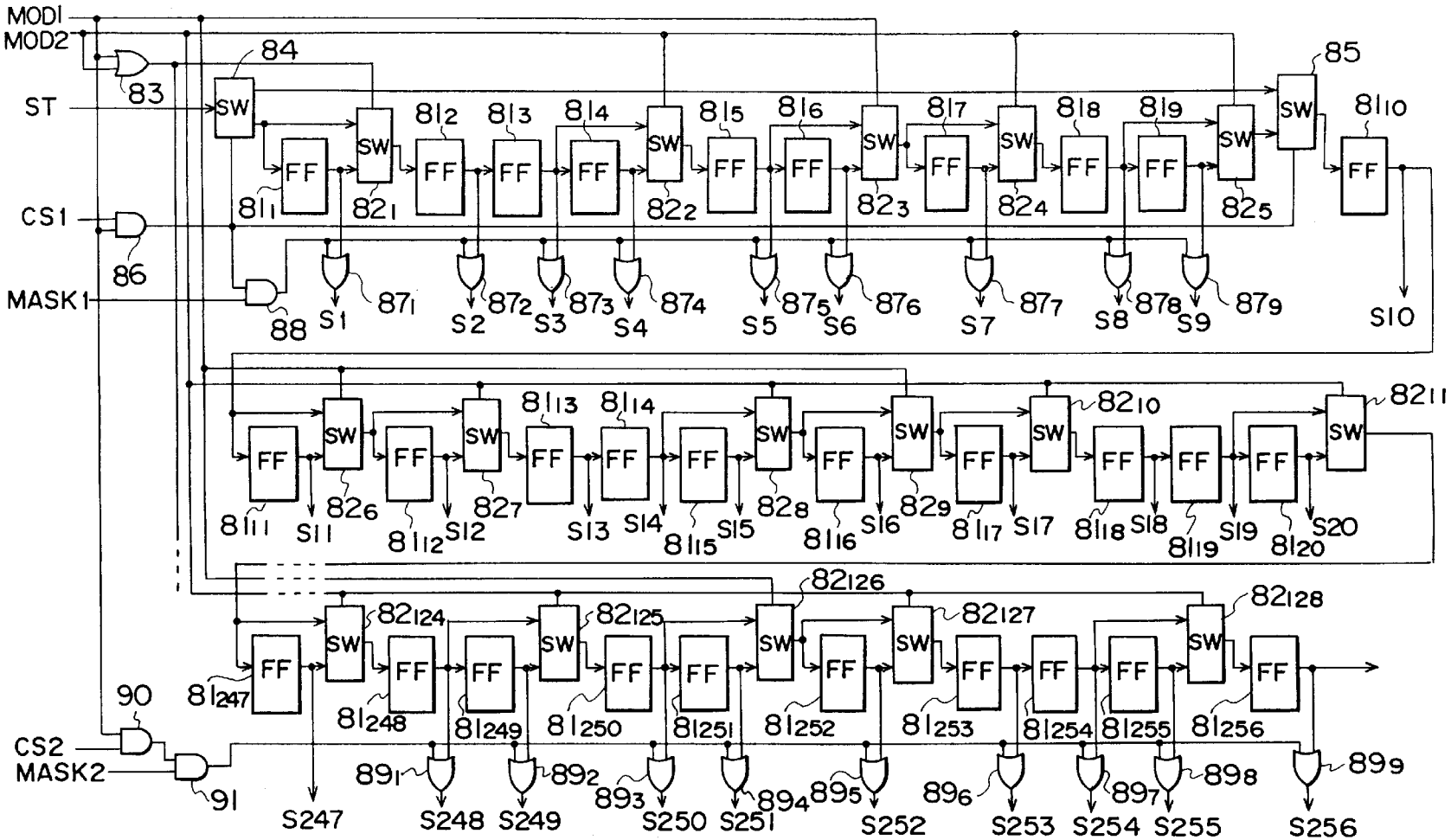
FIG. 9 is a structural diagram of the shift circuit 80*a* in FIG. 7.

FIG. 9 is a structural diagram of the shift circuit 80*a* shown in FIG. 7.

The basic structure of the shift circuit 80*a* is substantially the same as that of the shift circuit 70*a* shown in FIG. 8. Namely, the shift circuit 80*a* is provided with 256 FF circuits $\mathbf{81}_1$, $\mathbf{81}_2$, etc up to $\mathbf{81}_{256}$ for sequentially shifting start signals ST towards the rear in synchronization with clock signals CP and switches $\mathrm{SW}\mathbf{82}_1$, $\mathbf{82}_2$, $\mathbf{82}_3$, etc up to $\mathbf{82}_{128}$ for connecting a portion of the FF circuits (for example, FF $\mathbf{81}_1$, $\mathbf{81}_4$, etc) in parallel. Note that, although omitted from FIG. 9, clock signals CP are applied in common to the clock terminals of each FF circuit $\mathbf{81}_1$ to $\mathbf{81}_{256}$.

When "L" is fed to the control terminals of the switches $\mathrm{SW}\mathbf{82}_1$ to $\mathrm{SW}\mathbf{82}_{128}$, the output side of the FF circuit 81 immediately before the SW is connected to the input side of the FF circuit 81 immediately after the SW. When "H" is fed to the control terminals of the switches $\mathrm{SW}\mathbf{82}_1$ to $\mathrm{SW}\mathbf{82}_{128}$, the input side of the FF circuit 81 immediately before the SW is connected to the input side of the FF circuit 81 immediately after the SW.

For example, an OR of mode signals MOD1 and MOD2 is fed to the control terminal of $\mathrm{SW}\mathbf{82}_1$ via a two input OR gate 83. Moreover, mode signals MOD2 and MOD 1 are fed respectively to the control terminals of $\mathrm{SW}\mathbf{82}_2$ and $\mathrm{SW}\mathbf{82}_3$.

In 1.25 magnification mode, by setting the mode signal MOD1 to "H", one FF circuit 81 is connected in parallel to four FF circuits 81 connected in series by the $\mathrm{SW}\mathbf{82}_1$ to $\mathrm{SW}\mathbf{82}_{128}$. Five scan signals are output from five FF circuits 81 for four clock signal CP pulses. In 1.6 magnification mode, by setting the mode signal MOD2 to "H", three FF circuits 81 are connected in parallel to five FF circuits 81 connected in series. Eight scan signals are then output from eight FF circuits 81 for five clock signal CP pulses.

The shift circuit 80*a* is further provided with switches SW84 and SW85 for switching the connection with the start signal ST between the FF circuit $81_1$ and the FF circuit $81_{10}$. A start signal ST is fed to the input side of the switch SW84 and the first output side of this SW84 is connected to the input side of the FF circuit $81_1$. The second output side of the SW84 is connected to the second input side of the switch SW85, while the output side of the switch $SW82_5$ is connected to the first input side of the SW85. In addition, the output side of the SW85 is connected to the input side of the FF circuit $81_{10}$.

An AND of mode signal MOD1 and selection signal CS1 is fed to the control terminals of SW84 and SW85 via a two input AND gate 86. The output sides of the leading FF circuits $81_1$ to $81_9$ are connected respectively to the first input sides of the two input OR $87_1$, $87_2$, etc up to $87_9$.

An AND of the output side of the AND gate 86 and a mask signal MASK1 is formed in the AND gate 88 and fed to the second input sides of the OR gates $87_1$ to $87_9$. As a result, in enlarged display mode, the non-display regions of the leading portions are driven simultaneously by the mask signal MASK1.

The output sides of the nine FF circuits $81_{248}$, $81_{249}$, etc up to $81_{256}$ at the rear portion are connected respectively to the first input sides of the two input OR gates $89_1$, $89_2$, etc up to $89_9$. The AND in the AND gates 90 and 91 of the mode signal MOD1, the selection signal CS2, and a mask signal MASK2 is fed to the second input sides of the OR gates $89_1$ to $89_9$. As a result, in enlarged display mode, the non-display regions of the rear portions are driven simultaneously by the mask signal MASK2.

Next, while referring to FIGS. 8 and 9, the operation of the embodiment shown in FIG. 7 in normal display mode (1), 1.25 magnification display mode (2), and 1.6 magnification display mode (3) will be described.

(1) Normal Display Mode

In normal display mode, because the mode signals MOD1 and MOD 2 are set to "L", the output side of an FF circuit 71 is connected to the input side of the subsequent FF circuit 71 via the switches $SW72_1$ to SW $72_{64}$ in FIG. 8. The first FF circuit $71_1$ is connected to the switch SW74 through which start signals EI are input to the input side of the first FF circuit $71_1$. As a result, the shift registers 70*a* to 70*h* form a 128 stage shift register and the shift section 70 shown in FIG. 7 forms a 1024 stage shift register.

In the same manner, the output side of an FF circuit 81 is connected to the input side of the subsequent FF circuit 81 via the switches $SW82_1$, to $82_{128}$ in FIG. 9. The first FF circuit $81_1$ is connected to the switch SW84 through which start signals ST are input to the input side of the first FF circuit $81_1$. Further, because the first input side of the AND gates $87_1$ to $87_9$ and $89_1$ to $89_9$ are set to "H", the output signals of each FF circuit $81_1$ to $81_{256}$ are output without alteration as scan signals to the scan drive section 32. As a result, the shift registers 80*a* to 80*c* form a 256 stage shift register and the shift section 80 shown in FIG. 7 forms a 768 stage shift register.

The above described type of display operation is the same as the normal mode display operation in the LCD of the first embodiment shown in FIG. 1.

(2) 1.25 Magnification Display Mode

In 1.25 magnification display mode, the mode signals MOD1 and MOD2 are set respectively to "H" and "L". An image signal of 800 horizontal pixels is supplied in synchronization with the clock signals CK for every horizontal synchronizing signal HSYN from the PC and one vertical synchronizing signal VSYN is further supplied for 600 horizontal synchronizing signals HSYN.

Because the mode signals MOD1 and MOD2 are set respectively to "H" and "L", the FF circuits 71 in each of the shift registers 70*a* to 70*h* are connected at a ratio of one FF circuit 71 connected in parallel to four FF circuits 71 connected in series. Accordingly, when four clock signal CK pulses are supplied, sequential latch signals Li are output from five FF circuits 71 and R, G, B data is held in five latches 22*i*.

Furthermore, because an "H" selection signal CS0 is fed to the initial shift circuit 70*a*, start signals EI are applied to the thirteenth FF circuit $71_{13}$. Therefore, the latch signals L1 to L12 are not output from the FF circuits $71_1$ to $71_{12}$ and the initial R, G, B data D1 is held in the thirteenth FF circuit $71_{13}$. The R, G, B data D1 is then fed as a display voltage S37 to the thirty seventh Y electrode Y37 of the liquid crystal panel 40 and displayed. Accordingly, the 800 pixels in the horizontal direction of the image signal are increased to 1000 pixels and displayed on the Y electrodes Y37 to Y3036 of the liquid crystal panel 40.

In the same way, the FF circuits 81 in each of the shift circuits 80*a* to 80*c* are connected at a ratio of one FF circuit 81 connected in parallel to four FF circuits 81 connected in series. Accordingly, when four clock signal CP pulses are supplied, five scan signals are output from five FF circuits 81.

Furthermore, because an "H" selection signal CS1 is fed to the initial shift circuit 80*a*, start signals ST are applied to the tenth FF circuit $81_{10}$. Therefore, the scan signals are not output from the FF circuits $81_1$ to $81_9$ and the initial scan signal is fed from the tenth FF circuit $81_{10}$ to the scan drive section 32. The initial scan signal is then fed as a scan voltage G10 to the tenth X electrode X10 of the liquid crystal panel 40. MASK1 signals are input to the OR $87_1$ to $87_9$ and scan voltages G1 to G9 are output at the same timing to the X electrodes X1 to X9.

On the other hand, an "H" selection signal CS2 is fed to the final shift circuit 80*c*. Therefore, MASK2 signals are input to the OR gates $89_1$ to $89_9$ and scan voltages G760 to G768 are output at the same timing to the X electrodes X760 to X768. Accordingly, in 1.25 magnification display mode, the 600 lines in the vertical direction of the image signal are increased to 750 and displayed on the X electrodes X10 to X759 of the liquid crystal panel 40.

In this manner, in 1.25 magnification mode, a screen enlarged by a factor of 1.25 in both the horizontal and vertical directions is displayed in the central portion of the liquid crystal panel 40.

(3) 1.6 Magnification Display Mode

In 1.6 magnification display mode, the mode signals MOD1 and MOD2 are set respectively to "L" and "H". An image signal of 640 horizontal pixels is supplied in synchronization with the clock signals CK for every horizontal synchronizing signal HSYN from the PC, and one vertical synchronizing signal VSYN is further supplied for 480 horizontal synchronizing signals HSYN.

Because the mode signals MOD1 and MOD2 are set respectively to "L" and "H", the FF circuits 71 in each of the shift registers 70*a* to 70*h* are connected at a ratio of three FF circuits 71 connected in parallel to five FF circuits 71 connected in series. Accordingly, when five clock signal CK pulses are supplied, sequential latch signals Li are output from eight FF circuits 71 and R, G, B data Di is held in eight latches 22*i*. As a result, the 640 pixels in the horizontal direction of an image signal are increased to 1024 pixels and displayed on the Y electrodes Y1 to Y1024 of the liquid crystal panel 40.

In the same way, the FF circuits 81 in each of the shift circuits 80*a* to 80*c* are connected at a ratio of three FF circuits 81 connected in parallel to five FF circuits 81 connected in series. Accordingly, when five clock signal CP pulses are supplied, eight scan signals are output from five FF circuits 81. Accordingly, the 480 lines in the vertical direction of the image signal are increased to 768 and displayed on the X electrodes X1 to X767 of the liquid crystal panel 40.

As a result, in 1.6 magnification mode, a screen enlarged by a factor of 1.6 in both the horizontal and vertical directions is displayed over the entire display area of the liquid crystal panel 40.

In the manner described above, in addition to the normal display mode, the LCD of the second embodiment is provided with shift sections 70 and 80 capable of providing a plurality of enlarged display modes. Therefore, the present embodiment has the advantage that the supplied screen data can be enlarged by a factor of 1.25 or 1.6 and displayed on the liquid crystal panel 40 with practically no increase in the size of the circuit.

In addition when non-display portions are generated by the enlargement factor, because the shift sections 70 and 80 have the ability of displaying display areas in the central portion of the screen and displaying non-display areas as black, there is no offset towards the top left of the display screen allowing a natural display to be achieved.

Furthermore, the shift sections 70 and 80 are formed with shift circuits 70*a* and 80*a*, respectively using identical integrated circuits, connected in a cascade connection and differences in the operations thereof based on their locations are designated by selection signals CS0, CS1, and CS2. Consequently, the advantage is obtained that, by connecting the necessary number of shift circuits 70*a* and 80*a* to match the resolution of the display screen, the shift sections 70 and 80 are able to provide an optionally sized display screen.

Note that the present invention is not limited to the above embodiments and various modifications are possible. Variant examples include (a) to (d) described below.

(a) The display area of the liquid crystal panel 40 is not limited to 1024 pixels in the horizontal direction by 768 pixels in the vertical direction and the present invention may be applied in the same manner to a display area of any size.

(b) The rate of magnification is not limited to the magnifications 1.5, 1.25, and 1.6 used in the examples and the present invention may be applied to any rate of magnification.

(c) A matrix type display means such as a plasma display panel may be used instead of the liquid crystal panel 40.

(d) A logic gate switch such as a selector may be used instead of the SW (analog switches) 51*d*, 61*d*, 72, and 82.

As has been explained above in detail, according to the first aspect of the present invention, scan drive means is provided which generates scan voltages by forming shift registers having different numbers of stages by altering the connections of an M number of FF circuits, depending on the display mode. In addition, display drive means is provided which generates display voltages which accord with image data by forming shift registers having different numbers of stages by altering the connections of an N number of FF circuits, depending on the display mode. Therefore, in the matrix type display apparatus, the enlarged display of a screen can be achieved without increasing the size of the circuits.

According to the second aspect of the present invention, a switch SW is used for changing the plurality of FF circuit connections. Therefore, the circuit structure required for altering the connection can be simplified.

According to the third aspect of the present invention, the scan drive means is formed by connecting a plurality of integrated circuits in a cascade connection. Selection signals are fed to the positions of the connections thus allowing operations to be specified for each connection position. Therefore, scan drive means for an optional screen size can be simply formed.

According to the fourth aspect of the present invention, selection signals for the plurality of integrated circuits forming the scan drive means are directly fed from ground voltage or power supply voltage supplying the integrated circuits. Therefore, the wiring of the scan drive means can be simplified.

What is claimed is:

1. A matrix type display apparatus comprising:

a display section having M number of X electrodes arranged in parallel, M being a number greater than one, N number of Y electrodes arranged so as to intersect the X electrodes, N being a number greater than one, and display elements provided at each point of intersection of the X electrodes and Y electrodes, the display section performing a matrix type display in accordance with display voltages applied to each Y electrode at the points of intersection of the N number of Y electrodes and the X electrodes which are driven by scan voltages;

a scan drive section for generating the scan voltages in order to sequentially drive the X electrodes; and a display drive section for holding image data which corresponds to the X electrodes driven by the scan drive section, and for generating the display voltages based on the held image data so as to drive each of the Y electrodes, wherein the scan drive section is provided with M number of flip-flop circuits and switches for altering the connections of the M number of flip-flop circuits and, in normal display mode, the scan drive section forms shift registers having M number of stages by connecting the M number of flip-flop circuits in series and also generates the scan voltages based on each output signal of the M number of flip-flop circuits and, in enlarged display mode, the scan drive section forms shift registers having m number of stages, m being a number less than M, by connecting a portion of the M number of flip-flop circuits in parallel at a constant ratio and also generates the scan voltages based on each output signal of the M number of flip-flop circuits, and wherein the display drive section is provided with N number of flip-flop circuits and switches for altering the connections of the N number of flip-flop circuits and, in the normal display mode, the display drive section forms shift registers having N number of stages by connecting the N number of flip-flop circuits in series and also holds the image data based on each output signal of the N number of flip-flop circuits and generates the display voltages in accordance with the image data and, in the enlarged display mode, the display drive section forms shift registers having n number of stages, n being a number less than N, by connecting a portion of the N number of flip-flop circuits in parallel at the constant ratio and also holds the image data based on each output signal of the N number of flip-flop circuits and generates the display voltages in accordance with the image data.

2. The matrix type display apparatus according to claim 1, wherein switches in the scan drive section and the display drive section are formed from analog switches controlled by mode signals which designate the normal display mode or the enlarged display mode.

3. The matrix type display apparatus according to claim 1, wherein the scan drive section is provided with a plurality of integrated circuits used for shifting which are connected in a cascade connection and, in the enlarged display mode, the scan drive section simultaneously drives outputs of scan voltages for front or rear non-display regions based on selection signals which correspond to the integrated circuit connection position.

4. The matrix type display apparatus according to claim 3, wherein selection signals for a plurality of integrated circuits in the scan drive section are directly fed from ground voltage or power supply voltage supplying the integrated circuits.

5. The matrix type display apparatus according to claim 1, wherein the scan drive section is configured, when in the enlarged display mode, so as to apply the scan voltages to each of M-m X electrodes simultaneously with an adjacent one of the X electrodes, and the display drive section is configured in the enlarged display mode, so as to apply the display voltages to each of N-n Y electrodes simultaneously with an adjacent one of the Y electrodes.

6. A matrix type display apparatus comprising:

a display section having M number of X electrodes arranged in parallel, M being a number greater than one, N number of Y electrodes arranged so as to intersect the X electrodes, N being a number greater than one, and display elements provided at each point of intersection of the X electrodes and Y electrodes, the display section performing a matrix type display in accordance with display voltages applied to each Y electrode at the points of intersection of the N number of Y electrodes and the X electrodes which are driven by scan voltages;

a scan drive section for generating the scan voltages in order to sequentially drive the X electrodes; and a display drive section for holding image data which corresponds to the X electrodes driven by the scan drive section, and for generating the display voltages based on the held image data so as to drive each of the Y electrodes, wherein the scan drive section is provided with M number of flip-flop circuits and switches for altering the connections of the M number of flip-flop circuits and, in normal display mode, the scan drive section forms shift registers having M number of stages by connecting the M number of flip-flop circuits in series and also generates the scan voltages based on each output signal of the M number of flip-flop circuits and, in enlarged display mode, the scan drive section forms shift registers having m number of stages, m being a number less than M, by connecting a portion of the M number of flip-flop circuits in parallel at a constant ratio and also generates the scan voltages based on each output signal of the M number of flip-flop circuits.

7. The matrix type display apparatus according to claim 6, wherein switches in the scan drive section are formed from analog switches controlled by mode signals which designate the normal display mode or the enlarged display mode.

8. The matrix type display apparatus according to claim 6, wherein the scan drive section is provided with a plurality of integrated circuits used for shifting which are connected in a cascade connection and, in the enlarged display mode, the scan drive section simultaneously drives outputs of scan voltages for front or rear non-display regions based on selection signals which correspond to the integrated circuit connection position.

9. The matrix type display apparatus according to claim 8, wherein selection signals for a plurality of integrated circuits in the scan drive section are directly fed from ground voltage or power supply voltage supplying the integrated circuits.

10. The matrix type display apparatus according to claim 6, wherein the scan drive section is configured, when in the enlarged display mode, so as to apply the scan voltages to each of M-m X electrodes simultaneously with an adjacent one of the X electrodes.

11. A matrix type display apparatus comprising:

a display section having M number of X electrodes arranged in parallel, M being a number greater than one, N number of Y electrodes arranged so as to intersect the X electrodes, N being a number greater than one, and display elements provided at each point of intersection of the X electrodes and Y electrodes, the display section performing a matrix type display in accordance with display voltages applied to each Y electrode at the points of intersection of the N number of Y electrodes and the X electrodes which are driven by scan voltages;

a scan drive section for generating the scan voltages in order to sequentially drive the X electrodes; and a display drive section for holding image data which corresponds to the X electrodes driven by the scan drive section, and for generating the display voltages based on the held image data so as to drive each of the Y electrodes, wherein the display drive section is provided with N number of flip-flop circuits and switches for altering the connections of the N number of flip-flop circuits and, in the normal display mode, the display drive section forms shift registers having N number of stages by connecting the N number of flip-flop circuits in series and also holds the image data based on each output signal of the N number of flip-flop circuits and generates the display voltages in accordance with the image data and, in the enlarged display mode, the display drive section forms shift registers having n number of stages, n being a number less than N, by connecting a portion of the N number of flip-flop circuits in parallel at a constant ratio and also holds the image data based on each output signal of the N number of flip-flop circuits and generates the display voltages in accordance with the image data.

12. The matrix type display apparatus according to claim 11, wherein switches in the display drive section are formed from analog switches controlled by mode signals which designate the normal display mode or the enlarged display mode.

13. The matrix type display apparatus according to claim 11, wherein the display drive section is configured, when in the enlarged display mode, so as to apply the display voltages to each of N-n Y electrodes simultaneously with an adjacent one of the Y electrodes.

* * * * *